US005642750A

United States Patent [19]

Brown et al.

[11] Patent Number: 5,642,750

[45] Date of Patent: Jul. 1, 1997

[54] TENT HAVING A CONTINUOUS SEAMLESS PERIPHERAL SURFACE AND CONTAINING AN INTEGRAL SELF-INFLATING FLOOR

[76] Inventors: Judith A. Brown, 2870 S. Spur, Santa Fe, N.M. 87505; Jon C. Hagerty, P.O. Box 183, Chelsea, Vt. 05038

[21] Appl. No.: 595,411

[22] Filed: Feb. 5, 1996

Related U.S. Application Data

[60] Provisional application No. 60/006,807 Nov. 15, 1995.

[51] Int. Cl.[6] ..... E04B 1/34

[52] U.S. Cl. ..... 135/137; 135/124; 135/116; 135/156; 52/2.11; 52/2.17; 52/2.18; 5/723

[58] Field of Search ..... 52/2.11, 2.18, 52/2.17, 2.22; 135/156, 137, 116, 124, 87; 5/723

[56] References Cited

U.S. PATENT DOCUMENTS

| | | | |
|---|---|---|---|
| 4,000,585 | 1/1977 | Denaro | 52/2.17 |
| 4,000,749 | 1/1977 | Busco | 52/2.17 X |
| 4,607,655 | 8/1986 | Wagner et al. | 135/116 X |
| 4,852,598 | 8/1989 | Griesenbeck | 135/137 |
| 4,876,829 | 10/1989 | Mattick | 52/2.18 X |
| 5,007,212 | 4/1991 | Fritts et al. | 52/2.18 |
| 5,205,086 | 4/1993 | Heim | 52/2.18 X |
| 5,226,261 | 7/1993 | Wilbourn et al. | 52/2.22 X |
| 5,487,400 | 1/1996 | Dawkins | 52/2.11 X |

*Primary Examiner*—Wynn E. Wood
*Attorney, Agent, or Firm*—Daniel Robbins

[57] ABSTRACT

A tent is fabricated from a seamless spherical shell. The floor of the tent is established as a plane interiorly dividing the shell into two chambers. The floor peripherally contacts the inner surface of the shell, and is sealed against the inner surface of the spherical shell. The larger chamber serves as the living chamber, while a smaller air tight chamber is formed between the floor and the shell. The air tight chamber is provided with a valve communicating with the outside environment. When the tent is disassembled, and with the valve opened, the spherical shell will completely deflate and collapse. During erection of the tent, the air chamber valve remains open, and the shell's cap over the floor is manually pulled out away from the tent floor causing a vacuum to form in the smaller airtight chamber. Air immediately flows through the valve filling the air chamber, and by closure of this valve the air is trapped. The air cushions the floor to provide a self inflated air mattress. The self-inflating mattress also may be incorporated into a seamed floor in a conventional tent, or it may be used as a stand alone mattress.

20 Claims, 4 Drawing Sheets

TENT HAVING A CONTINUOUS SEAMLESS PERIPHERAL SURFACE AND CONTAINING AN INTEGRAL SELF-INFLATING FLOOR

This application claims the benefit of U.S. Provisional application Ser. No. 60/006,807, filed Nov. 15, 1995.

BACKGROUND OF THE INVENTION

1. Field of the Invention

This invention relates to portable, erectable shelters, and in particular to a seamless tent having an integral inflatable floor.

2. Description Relative to the Prior Art

Ongoing advances in methods of construction and in materials have improved the practicality and livability of currently available camping tents. While new materials have reduced tent weight for improved ease of carrying, and structural improvements have facilitated tent assembly and breakdown, among the problems that continue to plague campers are leaking tent seams in inclement weather, and the comfort level conveniently attainable in sleeping on a tent floor. U.S. Pat. No. 3,464,430 issued in the name of McQuaid discloses a tent fabricated from a seamless tube in which one end of the tube is formed into a seam which is sealed to form the tent enclosure. While the peripheral surfaces of the McQuaid tube are free of seams, the end seam is so positioned as to be substantially in contact with the ground when the tent is erected, and accordingly is vulnerable to leakage when exposed to ground water during a heavy downpour. U.S. Pat. No. 4,607,655 issued in the names of Wagner et al discloses a tent having an integral inflatable floor to provide a comfortable resting place for the tent occupant, but Wagner et al's floor requires inflation by a pump, a pneumatic bottle or other external inflating device. The present invention discloses a tent structure that addresses and simultaneously eliminates in a unique and novel manner both the prior art problem of potentially leaking seams, and the requirement for an auxiliary device to inflate a mattress integral with a tent floor.

SUMMARY OF THE INVENTION

The tent of the present invention is fabricated from a seamless spherical plastic, rubber or fabric shell whose radius is selected to be less than the height of the assembled tent. In a preferred embodiment, the spherical shell may be injected molded using one of the many resilient and impermeable plastics known in the art, and the thickness of the shell is chosen to be the wall thickness of the finished tent. The floor of the tent is established as a plane at a preselected distance, "D", from the equatorial plane of the sphere, and an entry flap is molded or cut into the sphere at this level. A circular planar tent floor of a radius such that the circumference of the floor just contacts the inner surface of the shell at the preselected distance "D" from the equatorial plane of the sphere is either molded into the shell during manufacture or is inserted into the shell through the entry flap, and is sealed against the inner surface of the spherical shell to be parallel to the equatorial plane of the sphere. The tent floor may be of the same plastic material as the spherical shell or it may be of a heavier material. This sealed floor divides the sphere into two chambers; a larger chamber containing the entry flap and other fenestration which serves as the living chamber, and a small air tight chamber formed by the floor and the spherical cap over the floor. The air chamber is provided with a valve communicating with the outside environment. For assembling the tent, a tubular metallic or plastic skeleton framework, either internal or external to the sphere, is removably attachable to the sphere to provide structural rigidity to the unit. This framework supports the spherical shell from the top of the sphere to the floor level when the tent is erected. It will be appreciated that when the tent is disassembled and the framework removed, and with the valve opened, the sphere will completely deflate and collapse. The entire sphere may now be compactly folded upon itself with no entrapped air. To erect the tent, the skeleton framework is assembled, and the plastic sphere is fitted to the framework and is attached to it. With the sphere rigidly attached to the framework, the tent is turned on its side so that the plane of the floor is perpendicular to the ground. The air chamber valve is now opened, and folded spherical cap over the floor is manually pulled out away from the assembled tent, causing a vacuum to form in the smaller chamber as the spherical cap unfolds and separates from the floor. Air immediately flows through the valve filling the air chamber, and by closure of this valve the air is trapped. When the tent is now turned upright on the ground, the air cushions the floor to provide a self inflated air mattress.

It will be noted that in the above preferred embodiment the tent of the invention has no external seams, and that the tent floor is self inflating without the need of an external pump or air bottle to inflate the mattress.

A second embodiment of the invention having a self inflating mattress and a peripherally seamless body is also disclosed.

Additionally, where a less sophisticated and less expensive tent may be acceptable, an embodiment disclosing the self inflating mattress floor incorporated as a seamed floor in a conventional tent is also disclosed.

BRIEF DESCRIPTION OF THE DRAWINGS

The invention will be described with respect to the drawings, of which.

DESCRIPTION OF THE PREFERRED EMBODIMENTS

Figure 1:
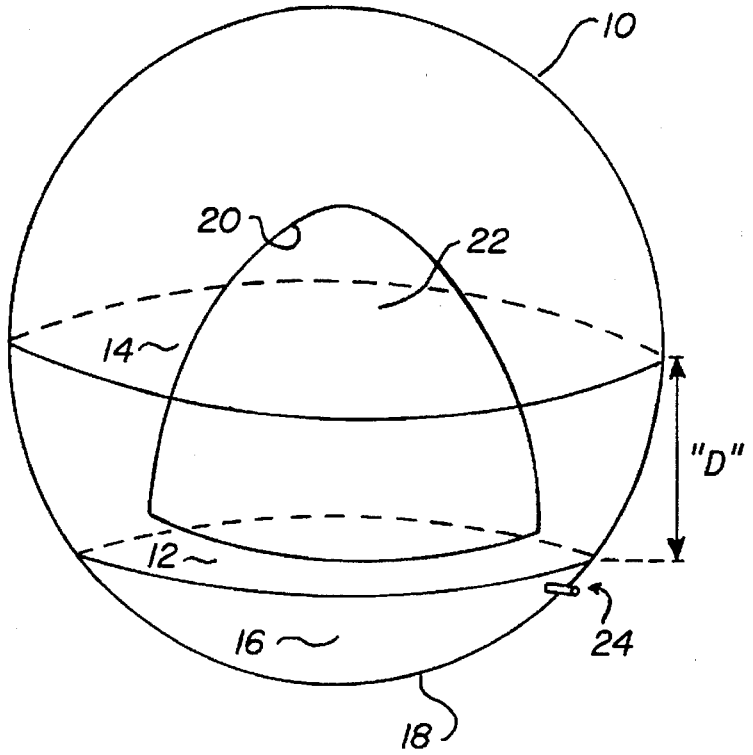
FIG. 1 is a drawing showing the basic shape of the tent of the invention.

Referring to FIG. 1, a hollow spherical plastic shell 10 forms the body of the tent of the invention. The shell 10 is fabricated from a resilient, impermeable, compliant plastic by injection molding or other process known in the art. A suitable plastic is "Arnitel", a high end polyamide polyester elastomer made by DSM Corp., Evansville Ind. The thickness of the shell 10, expressed in Denier, may be from 30 to 70, which approximates 1.5 to 4.5 oz./square yard, and the compliance of the material is such that the shell 10 is not structurally self supporting without additional bracing. Thus when not in use as a tent, the plastic shell may be compactly folded for storage or transport. A cut 20 molded during manufacture or separately made through the thickness of the shell 10 provides a moveable flap 22, (which will later serve as the entrance to the tent) to allow access to the interior of the shell 10. If not molded in place during manufacture, a plastic circular floor 12, which may be of the same material as the shell 10, may be inserted into the shell 10 at a distance "D" from an equatorial plane 14 and parallel to the plane 14, and the edge of the floor 12 sealed against the inside of the shell 10 along the full length of the circumference of the floor 12. The floor 12 secured at its edge to the interior of the shell 10, forms an air tight chamber 16 consisting of the volume between the floor 12 and the cap 18 of the shell 10. An air valve 24 is installed leading from the chamber 16 to the outside environment. It will be noted that there are no seams in the surface of the tent (with the exception of the cut 20 forming flap 22); the securing of the floor 12 to the interior of the shell 10 being accomplished completely within the shell 10 to preserve the airtight integrity of the structure.

Figure 2:
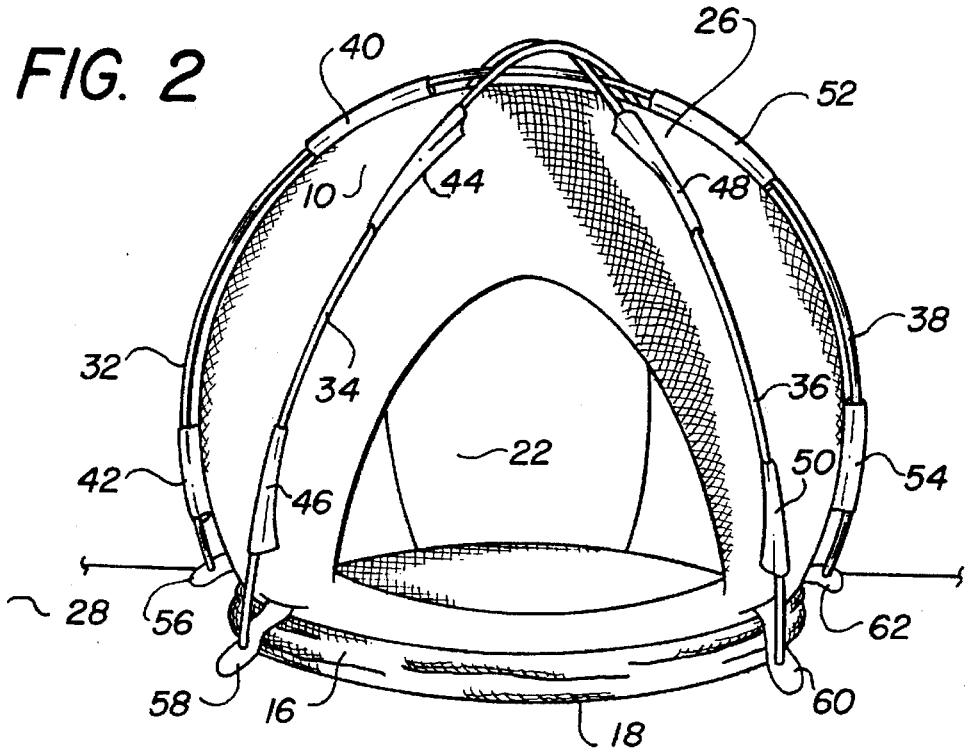
FIG. 2 is a drawing of the partially assembled tent of FIG. 1.

Referring to FIG. 2, a partially assembled tent 26 is shown positioned with the cap 18 in contact with the ground 28, and with the volume 16 deflated. An external substantially hemispherical skeleton frame consisting of tubular members 32,34,36,38 supports the shell 10 by means of straps 40,42, 44,46,48,50,52,54 which are adhesively attached to the external surface of the shell 10, and which include slots through which the tubular members 32–38 are threaded to support the shell 10 in a quasi-hemispherical form. Tabs 56,58,60,62 attached to the of shell 10 receive the foot ends of the framework members 32,34,36,38 for securing the tent 26 and the framework to the ground 28 by means of pegs. At this stage in tent 26 assembly, the tent 26 is not secured to the ground 28.

Figure 3A:
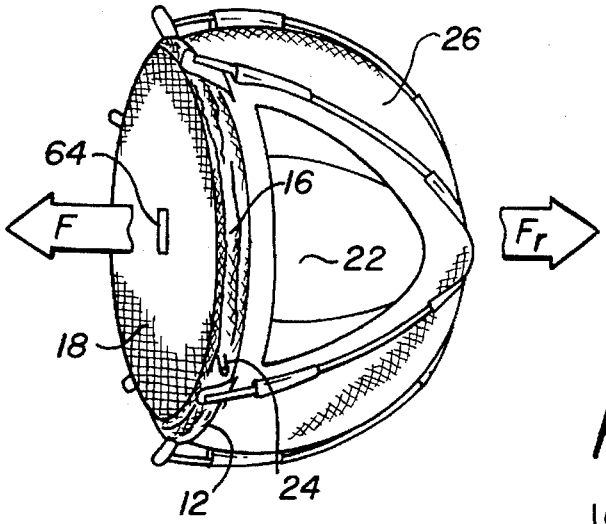
FIGS. 3*a*,3*b* illustrate a step in self inflating the mattress of the tent of FIG. 1.
Figure 4:
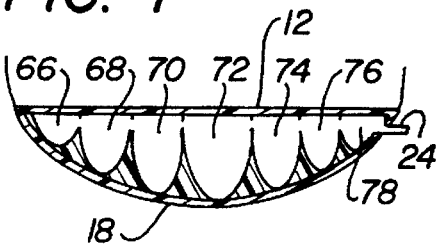
FIG. 4 is a cross section drawing of one embodiment of the inflated mattress of the tent of FIG. 1 before staking the tent down.
Figure 3B:
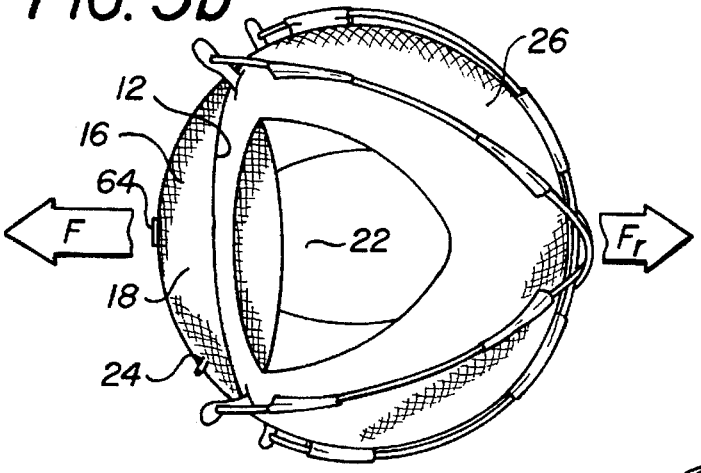

In order for the floor to self inflate, the tent 26 is first tipped onto its side as shown in FIG. 3*a*. As stated above, when the tent 26 is disassembled and folded for transportation or storage, the air tight space formed between the cap 18 and the floor 12, i.e., volume 16, is negligible because there is no air trapped in the volume 16 as the valve 24 is open. Inflating the tent requires no external source of air; a strap 64 secured to the cap 18 is manually pulled with a force F as shown in FIG. 3*a*. (A reactive force $F_r$ must be provided in the opposite direction to keep the entire tent 26 from moving under the influence of the force F.) The force F pulls the cap 18 away from the floor 12, increasing the volume 16 and forming a vacuum in the volume 16, and as the valve 24 is open, air rushes in filling the volume 16. FIG. 3*b* shows the cap partially separated from the floor 12, increasing the volume 16. After the cap 18 has been pulled away from the floor 12 to provide the maximum volume 16 available, the valve 24 is closed trapping the air in the volume 16 providing an air mattress of which the floor 12 is the upper surface. It will be noted that the volume 16 may either be a single cavity as described above, or may be a chambered set of interconnected sub-cavities 66–78 as shown in FIG. 4.

Figure 5:
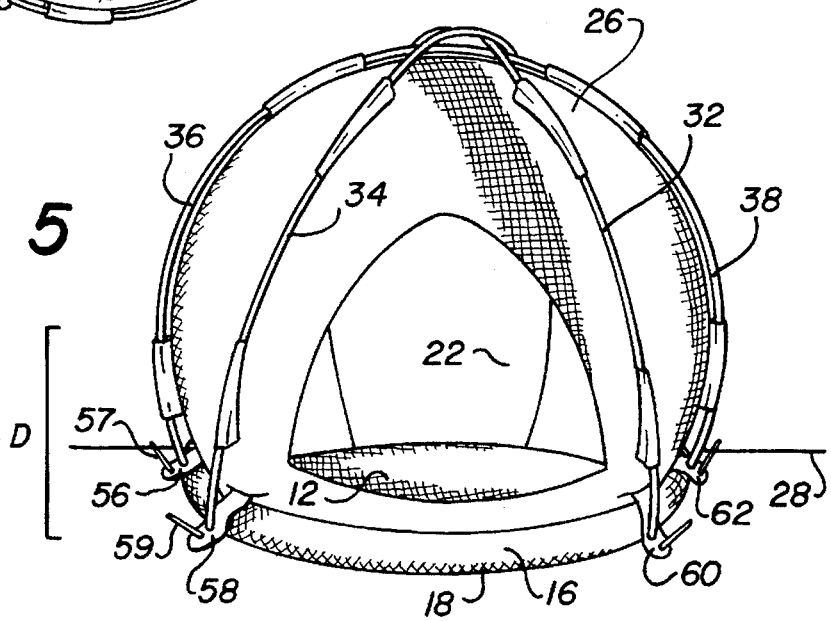
FIG. 5 is a view of the tent of FIG. 1 showing the tent secured to the ground.

After the volume 16 is inflated, the tent 26 is returned to its upright position, and the tabs 56–62 are staked to the ground to secure the tent 26 is position. (FIG. 5 shows stake 57 holding down tab 56, and stake 59 holding down tab 58). The cap 18 is now substantially flat, as it is in contact with the ground 28, while the volume 16 being filled with air, forces the floor 12 upward to form the air mattress.

Figure 6A:
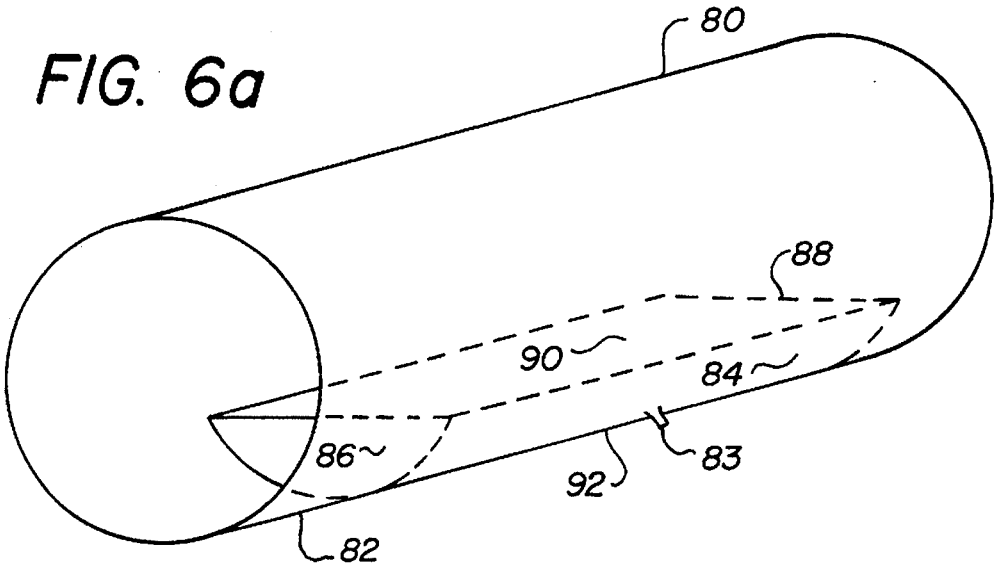
FIGS. 6*a*,6*b* are drawings of a seamless knitted or molded tube used in a second embodiment of the invention.

As described above, the tent of the preferred embodiment is completely seamless (except for the entry flap and other fenestrations), and includes a self inflating mattress incorporated into the tent floor. In a second embodiment, the tent is shaped from a knitted or molded seamless tube of fabric, rubber or plastic so that the peripheral surfaces of the tent are seamless, i.e. the bottom, side walls and top of the assembled tent are seamless, and the tent has protected seams at its end faces, as will be described below. Referring to FIG. 6*a*, a fabric, rubber or plastic tube 80 is knitted or molded from nylon or other filamentary or non filamentary material. The material is selected so that the resultant material is air tight and impermeable to water. The portion of the tube 80 which will serve as the tent base 82 and floor 90 may be manufactured from heavier material than the rest of the tube 80. During fabrication a cavity 84 between the points 86,88 is seamlessly knitted or molded into the body of the tube 80. The interior surface 90 (FIGS. 6*a*,6*b*) and the external cap 92 form the air tight cavity 84 which serves as an air mattress.

Figure 6B:
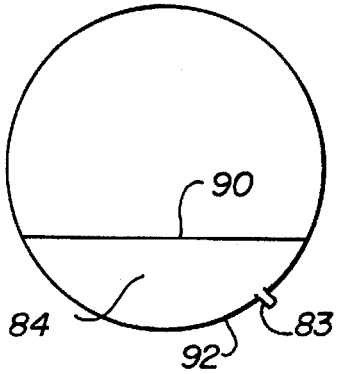
Figure 7A:
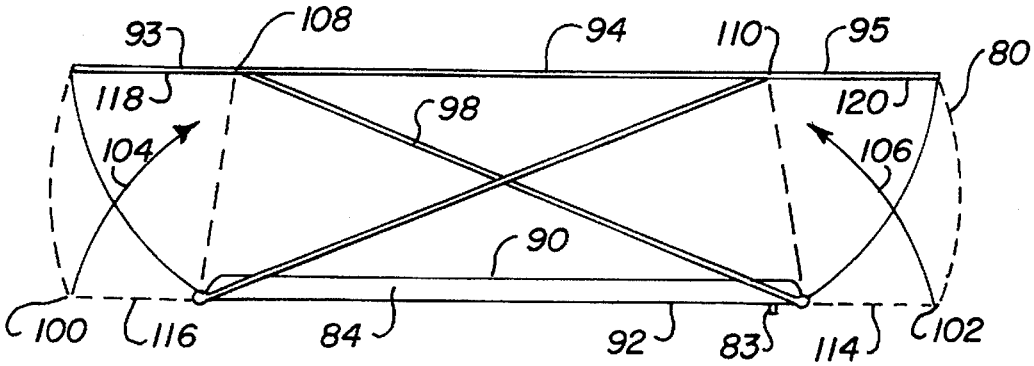
FIGS. 7*a*,7*b* are drawings showing the tent formed from the tube of FIGS. 6*a*,6*b*, and FIGS. 8*a*,8*b* are drawings showing the self inflating floor incorporated into a conventional tent.
Figure 7B:
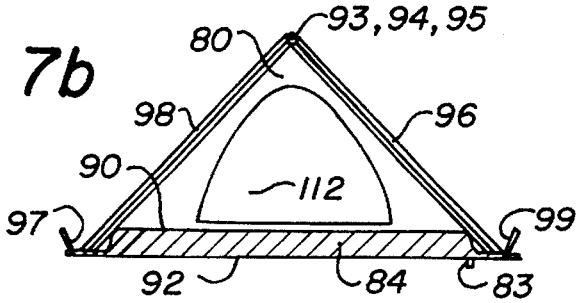

Referring to FIG. 7*a*, the tent is formed from the tube 80 of FIG. 6*a*,6*b*, by attaching a ridge pole 94, having hinged extensions 93, 95 and supporting frames 96,98, to the tube 80. (Frame 96 supports the other wall of the tent and is not seen in FIG. 7*a*). In FIG. 7*b* a cross section view of the tent shows the ridge pole 94, and ridge pole extensions 93,95 and frames 96,98 forming the tube 80 into a triangularly shaped tent. Referring again to FIG. 7*a*, bottom edges 100,102 of the tube 80 are folded up in the directions of the arrows 104,106 and are fastened to the structure consisting of the ridge pole 94 and the frames 96,98 at the points 108,110. The segment of the tube between the point 100 and the frame 98, labelled 116, and similarly the segment between the point 102 and the frame 98, labelled 114, after folding become the end faces of the tent. A door 112 may be provided in the turned up end face 116 for entry into the tent. It will be noted that there are seams only in the end faces of the turned up portions 114,116 of the tube 80; the peripheral surfaces of the tent formed from the tube 80 are completely seamless. The seams may be tightly secured with temporary closures such as Velcro closures or zippers. Also the seams at the end faces 114,116 are protected by the overhanging portions 118,120 of the tube 80, which may be folded down by folding down the ridge poles extensions 93,95 over the end faces of the tent in the case of a driving rain.

Referring again to FIG. 7*b*, the cavity 84 formed between the floor 90 and the external cap 92 is seen in inflated form. The valve 83 is closed, the cavity 84 of the air mattress having been inflated in the analogous manner to that described above in the case of the quasi-hemispherical tent 26 of FIG. 5. Also, as previously disclosed in connection with the tent 26 of FIG. 5, the tent of FIGS. 7*a*,7*b* is staked to the ground by means of stakes through tabs 97,99 attached to the frames 96,98, compressing the air entrapped in the cavity 84 to force the floor surface 90 upwards, where it serves as the upper surface of the self inflated air mattress. The cavity may also be provided with chambers such as those shown in FIG. 4.

Figure 8A:
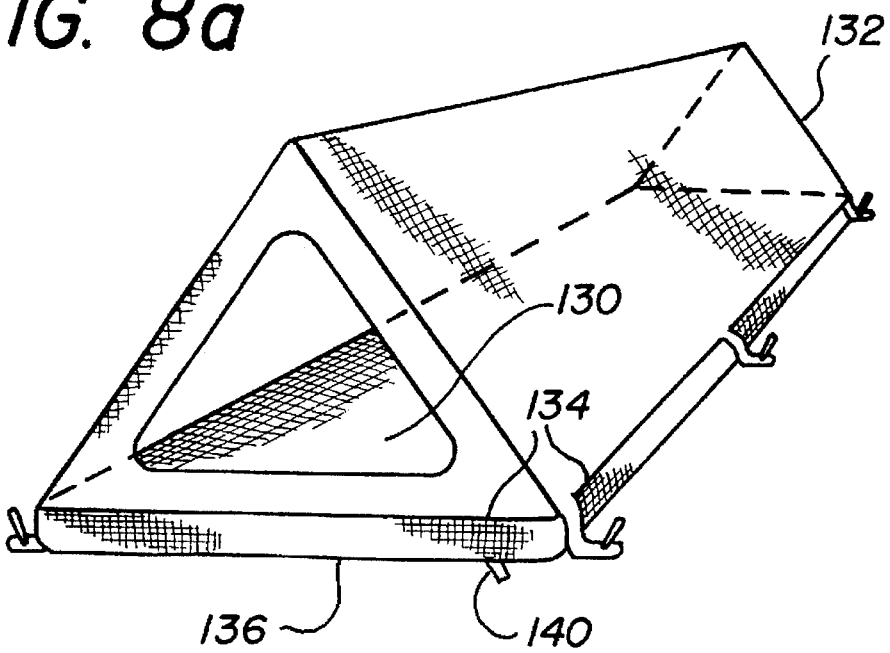
Figure 8B:
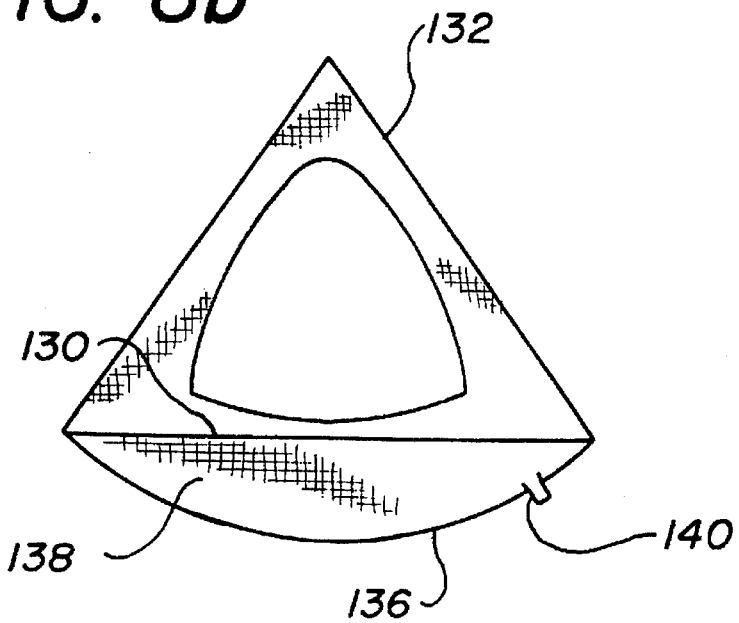

The above disclosed tents having seamless peripheral surfaces and self inflating mattress floors are the more advanced and sophisticated embodiments of the invention. It will be appreciated that the self inflating floor may be installed in a conventional tent wherein the self inflating mattress floor is joined to the side surfaces of the tent by use of a seam. Referring to FIG. 8*a*, a conventional tent fabricated from materials known in the art has a flexible floor 130 which is secured to the tent 132 by means of a seam 134 between the floor 130 and the material of the tent 132. The bottom of the tent consists of a pliable, impermeable cap 136, which is sealed to the edge of the floor 130 to form a air tight cavity 138 (FIG. 8*b*). A valve 140 is provided in the cavity 138. It is seen that the resultant floor 130 and cap 136 structure is identical to that disclosed in FIGS. 1–6 above, and provides a self inflating mattress floor, as previously described, for incorporation into a conventional tent.

The invention has been described in detail with particular reference to preferred embodiments thereof, but it will be understood that variations and modifications can be effected within the spirit and scope of the invention.

What is claimed is:

1. A tent comprising:

a) a continuous shell of impermeable pliable material having a substantially hollow interior volume, b) a planar impermeable pliable sheet peripherally attached to said shell in said interior volume wherein said sheet divides said interior volume into first and second sub-volumes, said sheet forming an interior floor of said tent, c) a valve communicating between said second sub-volume and the outside environment, d) means for mechanically expanding said second sub-volume when said valve is open, said means for mechanically expanding said second sub-volume further comprising means for applying an external force to the surface of said second sub-volume for expansion of said second sub-volume and having no additional internal means within said second sub-volume for aiding said expansion of said second sub-volume, whereby air from said outside environment is drawn into said second sub-volume, and e) means for closing said valve trapping said air in said second sub-volume to form an inflated sub-volume contiguous to said floor of said tent, whereby the external surface of said tent is peripherally seamless and whereby said inflated sub-volume serves as a self-inflated mattress for said tent.

2. The tent of claim 1 further comprising means for dividing said sub-volume into a multiplicity of cavities.

3. The tent of claim 2 wherein said means for dividing said sub-volume comprises a series of pneumatically connected chambers.

4. The tent of claim 1 wherein said continuous shell is a plastic material.

5. The tent of claim 1 wherein said sheet is a plastic material.

6. A tent comprising:

a) a first substantially pliable impermeable planar layer, b) a second substantially pliable impermeable planar layer attached to said first impermeable planar layer at the peripheral edges of said first and said second impermeable planar layers wherein an air tight cavity is formed between said first and said second impermeable planar layers, and c) a valve communicating between said cavity and the outside environment, whereby when said valve is open said cavity may be deflated by compressing said first impermeable layer and said second impermeable layer, and wherein said first layer further comprises means for applying a force external to said cavity for mechanically pulling said first layer away from said second layer with no additional means internal to said cavity to aid said force, whereby air enters and fills the vacuum formed in said cavity, and further whereby when said valve is subsequently closed said air is trapped in said cavity to form a self inflatable floor of said tent.

7. The tent of claim 6 further comprising means for dividing said cavity into a multiplicity of sub-cavities.

8. The tent of claim 7 wherein said means for dividing said cavity comprises a series of pneumatically connected chambers.

9. The tent of claim 6 wherein said first impermeable planar layer and said second impermeable planar layer are plastic materials.

10. A mattress comprising:

a) a first substantially pliable impermeable planar layer, b) a second substantially pliable impermeable planar layer attached to said first impermeable planar layer at the peripheral edges of said first and said second impermeable planar layers wherein an air tight cavity is formed between said first and said second impermeable planar layers, and c) a valve communicating between said cavity and the outside environment, whereby when said valve is open said cavity may be deflated by compressing said first impermeable layer and said second impermeable layer, and wherein said cavity further comprising means for application of an external force to the surface of said cavity for expansion of said cavity with no additional internal means in said cavity to aid in said expansion, so that air enters and fills the vacuum formed in said cavity, and further whereby when said valve is subsequently closed said air is trapped in said cavity to form said inflatable mattress.

11. The mattress of claim 10 wherein said mattress is incorporated into the floor of a tent.

12. The mattress of claim 10 further comprising means for dividing said cavity into a multiplicity of sub-cavities.

13. The mattress of claim 12 wherein said means for dividing said cavity comprises a series of pneumatically connected chambers.

14. The mattress of claim 10 wherein said first layer and said second layer are plastic materials.

15. A mattress comprising;

a) an airtight compressible bladder, b) means for mechanically expanding said bladder to form interior cavity within said bladder whereby a vacuum forms in said cavity when said bladder is mechanically expanded, said means for mechanically expanding said bladder further comprising means for external application of a force to a surface of said cavity for expansion of said cavity with no internal means within said cavity aiding in said expansion, and b) control means connecting the interior of said bladder to the outside environment, said control means controlling the flow of air to and from said interior of said bladder and said outside environment, whereby when said bladder is compressed said control means allows the flow of outflowing air from said bladder to said environment, and when said bladder is expanded said control means allows inflowing air to flow into said bladder, said control means further allowing the retention of said inflowing air within said bladder.

16. The mattress of claim 15 wherein said mattress is incorporated into the floor of a tent.

17. The mattress of claim 15 further comprising means for dividing said cavity into a multiplicity of sub-cavities.

18. The mattress of claim 17 wherein said means for dividing said cavity comprises a series of pneumatically connected chambers.

19. The mattress of claim 15 wherein said bladder comprises a plastic material.

20. The mattress of claim 15 wherein said control means is a pneumatic valve.

* * * * *